US006073956A

United States Patent [19]

Zemke et al.

[11] Patent Number: 6,073,956

[45] Date of Patent: Jun. 13, 2000

[54] SNOWBOARD WITH HONEYCOMB AT TIP AND TAIL

[75] Inventors: Hubert R. Zemke, Carson City, Nev.; John D. Moore, Seattle, Wash.

[73] Assignee: Sims Sports, Inc., Bothell, Wash.

[21] Appl. No.: 08/881,014

[22] Filed: Jun. 23, 1997

Related U.S. Application Data

[63] Continuation of application No. 08/861,504, Jun. 4, 1997, abandoned.

[51] Int. Cl.[7] ..... A63C 5/14

[52] U.S. Cl. ..... 280/610; 280/14.2

[58] Field of Search ..... 280/610, 14.2, 280/609, 611, 601, 602, 608; 428/102, 105, 107

[56] References Cited

U.S. PATENT DOCUMENTS

| | | | |
|---|---|---|---|
| 3,734,519 | 5/1973 | Bennett | 280/610 |
| 3,893,681 | 7/1975 | Mannings et al. | 280/610 |
| 4,455,037 | 6/1984 | Pilpel et al. | 280/610 |
| 4,647,063 | 3/1987 | Piringer et al. | 280/610 |
| 5,769,445 | 6/1998 | Morrow | 380/610 |

*Primary Examiner*—Richard M. Camby

*Attorney, Agent, or Firm*—Townsend and Townsend and Crew LLP

[57] ABSTRACT

A snowboard (4) includes a core (10) having tip and tail portions (20, 22) with a center portion (9) therebetween. The tip and tail portions both include lightweight, high strength honeycomb material (18) to reduce the mass moment of inertia of the snowboard. Doing so reduces the spin weight of the snowboard and permits the user to turn the snowboard about a vertical axis (26) more easily.

26 Claims, 1 Drawing Sheet

SNOWBOARD WITH HONEYCOMB AT TIP AND TAIL

CROSS REFERENCE TO RELATED APPLICATION

This application is a continuation of U.S. patent application Ser. No. 08/861,504 filed Jun. 4, 1997, now abandoned.

BACKGROUND OF THE INVENTION

Snowboarding has become an increasingly popular alternative to alpine snow skiing. Snowboards are typically about 150 cm (5 ft.) long by 30 cm (1 ft.) wide and have a pair of boot bindings mounted to their upper surfaces. The snowboard includes a core typically made of, for example, different woods such as poplar, suma and aspen, various synthetic materials such as polyurethane, or a combination of natural and artificial materials. The core is typically encased within a composite material, such as fiberglass fibers within an epoxy matrix.

As the sport of snowboarding has matured, snowboarders have expanded their repertoire performing some amazing feats with their snowboards. One type of movement involves spinning the snowboard about a generally vertical axis.

SUMMARY OF THE INVENTION

The present invention is directed to a snowboard and and its method of construction by which the mass moment of inertia, also called swing weight, of the snowboard is reduced while maintaining the desired shear strength and compressive strength of the snowboard. Reducing the swing weight permits snowboarders to more easily perform many maneuvers.

The snowboard core has tip and tail portions with a center portion therebetween. The tip and tail portions both include lightweight, high strength honeycomb material to reduce the mass moment of inertia of the snowboard while not sacrificing strength. Doing so permits the user to turn the snowboard about a vertical axis more easily.

The honeycomb material at the tip and tail portions together comprise about 6% to 9% of the volume of the core. The density of the honeycomb material is preferably less than about 8.5 lbs. per cubic foot, and more preferably between about 3 to 8 lbs. per cubic foot.

The snowboard is preferably designed and constructed such that its mass moment of inertia is at most about 80% of the mass moment of inertia the snowboard would have had if no honeycomb material were used for the core.

Other features and advantages of the invention will appear from the following description in which the preferred embodiment has been set forth in detail in conjunction with the accompanying drawings.

DESCRIPTION OF THE PREFERRED EMBODIMENT

Figure 1:
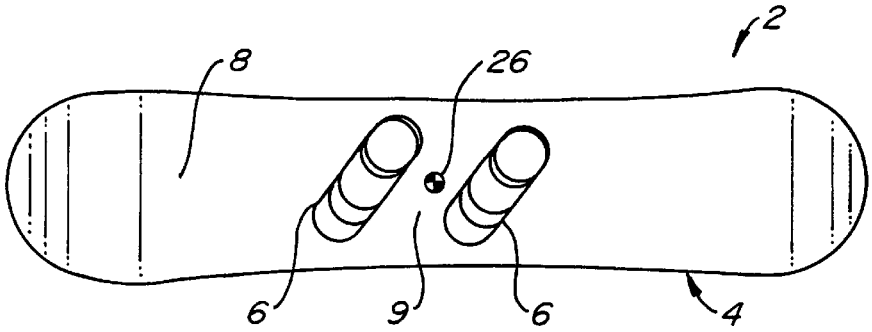
FIG. 1 is a simplified plan view of a snowboard assembly made according to the invention.
Figure 2:
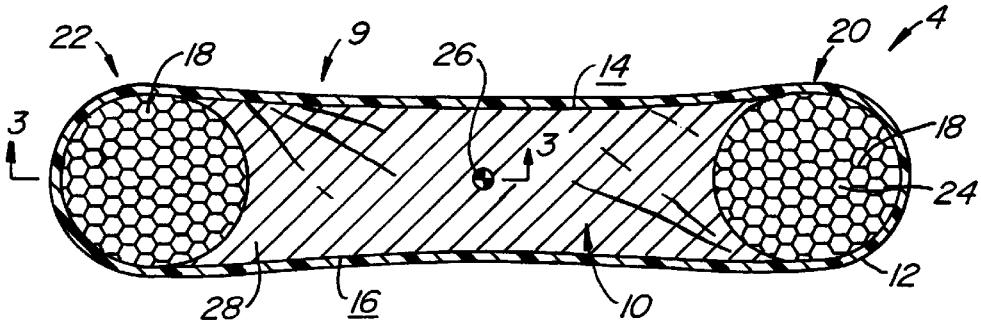
FIG. 2 is a cross-sectional plan view of the snowboard of FIG. 1 illustrating the honeycomb material at the tip and tail portions.

FIG. 1 illustrates a snowboard assembly 2 including a snowboard 4 to which a pair of bindings 6 are mounted to the top 8 of snowboard 4. Bindings 6 are preferably mounted to a center portion 9 of a snowboard 4, as is conventional. FIG. 2 is a simplified horizontal cross-section through the snowboard 4 of FIG. 1. Snowboard 4 includes a core 10 completely surrounded by a skin 12. Skin 12 is preferably a composite material. In one embodiment, skin 12 covering upper surface 14 of core 10 is made of fiberglass fibers within an epoxy matrix while skin 12 covering lower surface 16 of core 10 is made of graphite fibers within an epoxy matrix. Other fibers, such as aramid fibers, such as those sold under the trademark Kelvar®, or a combination of fiberous materials, could also be used. Skin 12 could also be made of a metal such as aluminum. In the preferred embodiment, skin 12 is made from a prepreg material; a wet lay-up type of material could also be used.

Figure 3:
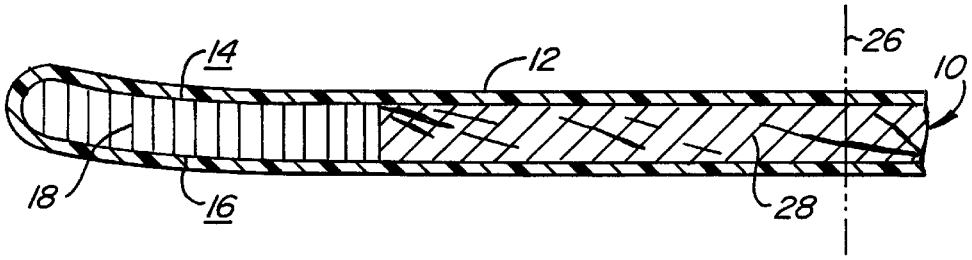
FIG. 3 is a simplified cross-sectional view taken along ling 3—3 of FIG. 2.

Core 10 includes honeycomb material 18 at both its tip portion 20 and tail portion 22. As illustrated in FIGS. 2 and 3, honeycomb material 18 is of the hexagonal type, that is having vertically oriented, hexagonal cavities 24. This orientation provides superior shear strength and crush (compression) strength between upper and lower surfaces 14,16. Hexagonal cavities 24 are preferably oriented parallel to the vertical spin axis 26 which passes through and generally perpendicular to surfaces 14,16.

Honeycomb material 18 can be made by different processes including the corrugation method and the expansion method, as well as extrusion. Cavities 24 need not be hexagonal but could be other shapes, such as cylinders, other regular polygons and irregular polygons.

In the preferred embodiment, honeycomb material 18 at tail portion 22 and tip portion 20 each occupy about one-third of the total volume of core 10. Preferably, honeycomb material 18 is made of aluminum honeycomb weighing about 8.1 lbs. per cubic foot. It is preferred that honeycomb material 18 used weigh a maximum of about 8.5 lbs. per cubic foot and preferably about 3 to 8 lbs. per cubic foot. Materials other than aluminum, such as paper, fiberglass composites, and plastics such as Nomex®, can also be used. The remainder of core 10, most of which constitutes center portion 28 of core 10, is made of different woods with varying percentages of in-grain (horizontal grain) and end-grain (vertical grain) configurations. This material is sometimes referred to herein as center portion material 28.

Honeycomb material 18 preferably has a density of no more than about 33% of the density of center portion material 28. The total weight of honeycomb material 18 is preferably at most about 25%, and more preferably at most about 15%, of the total weight of core 10. The total volume of honeycomb material is preferably about 6% to 9% of the total volume of core 10.

While it is possible to make the entire core 10 out of honeycomb material 18, it is not necessarily advantageous to do so for several reasons. These include the potentially lower damage tolerance from flatwise compressive forces, the higher cost of honeycomb and the increased risk of potential bonding problems.

Core 10 has a mass moment of inertia, measured about polar axis 26, of about 205 lb in$^2$. If core 10 included no honeycomb material 18 but if the entire core 10 were made of poplar/aspen/suma, that is made completely of center portion material 28, such a core would have a mass moment of inertia of about 280 lb in$^2$. With the present invention, the mass moment of inertia of core 10 including honeycomb material 18 at tip portion 20 and tail portion 22 has a mass moment of inertia of no more than about 80%, and preferably no more than about 65%, of the mass moment of inertia of core 10 made completely of center portion material 28 and without any honeycomb material 18. Note that these percentages are for core 10 only; the percentage will be higher for snowboard 4, the thicker (and heavier) skin 12 the higher the percentage.

Modification and variation can be made to disclose the embodiment without departing from the subject of the invention as defined in the following claims. For example, center portion material 28 can be a number of different synthetic and/or natural materials uniformly or non-uniformly distributed within core 10.

What is claimed is:

1. A snowboard comprising:

a core having a tip portion, a center portion and a tail portion, the tip portion and the tail portion each comprising honeycomb material, the center portion comprising center portion material which is other than honeycomb material;

the core having an upper surface and a lower surface and a polar axis passing through and generally perpendicular to the upper and lower surfaces;

a skin covering said core; and the skin along the upper surface being made of one or more of fiberglass and graphite fibers within an epoxy matrix, and the skin along the lower surface being made of fiberglass fibers embedded within an epoxy matrix.

2. The snowboard according to claim 1 wherein said honeycomb material at said tip and tail portions each comprise about one-third of the total volume of said core.

3. The snowboard according to claim 1 wherein said honeycomb material has a density of less than about 8.5 pounds per cubic foot.

4. The snowboard according to claim 1 wherein said honeycomb material has a density of about 3 to 8 pounds per cubic foot.

5. The snowboard according to claim 1 wherein said honeycomb material density is at most about 33% of the density of the center portion material.

6. The snowboard according to claim 1 wherein the total weight of the honeycomb material is at most about 25% of the total weight of the core.

7. The snowboard according to claim 1 wherein the total volume of the honeycomb material is about 6% to 9% of the total volume of the core.

8. The snowboard according to claim 1 wherein said honeycomb material comprises one or more of aluminum honeycomb, fiberglass fiber honeycomb, graphite fiber honeycomb and nomex fiber honeycomb.

9. The snowboard according to claim 1 wherein said honeycomb material is aluminum honeycomb material.

10. The snowboard according to claim 1 wherein the same said honeycomb material is used for the tip and tail portions.

11. The snowboard according to claim 1 wherein said honeycomb material defines generally hexagonal open regions therein.

12. The snowboard according to claim 1 wherein the center portion material comprises at least one of the following materials: wood, polyurethane foam.

13. The snowboard according to claim 1 wherein the center portion material comprises wood.

14. The snowboard according to claim 13 wherein the skin is a composite material.

15. A snowboard comprising:

a core having a tip portion, a center portion and a tail portion, the tip portion and the tail portion each comprising honeycomb material, the center portion comprising center portion material which is other than honeycomb material;

the core having an upper surface and a lower surface and a polar axis passing through and generally perpendicular to the upper and lower surfaces;

a skin covering said core; and the core having a first mass moment of inertia relative to the polar axis, said first mass moment of inertia being at most about 80% of a second mass moment of inertia, said second mass moment of inertia being the mass moment of inertia of said core if said core were made only of said center portion material.

16. The snowboard according to claim 15 wherein the skin comprises at least one of the following materials: aluminum and fiberglass fibers, graphite fibers, and aramid fibers embedded within a matrix material.

17. The snowboard according to claim 16 wherein the matrix material is an epoxy matrix.

18. The snowboard according to claim 1 wherein the core has a first mass moment of inertia relative to the polar axis, said first mass moment of inertia being at most about 80% of a second mass moment of inertia, said second mass moment of inertia being the mass moment of inertia of said core if said core were made only of said center portion material.

19. A method for making a snowboard, comprising the following steps:

choosing honeycomb material for the tip and tail portions of a core of a snowboard;

selecting the shapes, sizes and positions of the honeycomb material at the tip and tail portions;

manufacturing the core with the tip and tail portions comprising said honeycomb material separated by a center portion material which is other than a honeycomb material;

the choosing and selecting steps being carried out so that the core has a first mass moment of inertia relative to a polar axis passing through and generally perpendicular to the upper and lower surfaces so said first mass moment of inertia is at most about 80% of a second mass moment of inertia, said second mass moment of inertia being the mass moment of inertia of the core if said core were made only of said center portion material; and encasing said core with a skin to create said snowboard.

20. The method according to claim 19 wherein the selecting step is carried out so the honeycomb material at the tip and tail portions each comprise about 6% to 9% of the volume of the core.

21. The method according to claim 19 wherein the selecting step is carried out so the honeycomb material having a density of less than about 8.5 pounds per cubic foot.

22. The method according to claim 19 wherein the selecting step is carried out so the honeycomb material has a density of about three to eight pounds per cubic foot.

23. The method according to claim 19 wherein the selecting step is carried out so the honeycomb material has a density which is no more than about 33% of the density of the center portion material.

24. The method according to claim 19 wherein the selecting step is carried out so the total weight of the honeycomb material is at most about 25% of the total weight of the core.

25. The method according to claim 19 wherein the choosing step is carried out by choosing one or more of aluminum honeycomb material, fiberglass fiber honeycomb, graphite fiber honeycomb, and aramid fiber honeycomb, and further comprising the step of choosing a composite material as the skin.

26. The method according to claim 25 wherein the skin choosing step is carried out by choosing one or more of fiberglass and graphite fibers within an epoxy matrix for an upper portion of the skin and fiberglass fibers within an epoxy matrix for a lower portion of the skin.

* * * * *